US005332007A

United States Patent [19]

Wahhoud

[11] Patent Number: 5,332,007

[45] Date of Patent: Jul. 26, 1994

[54] FAULTY WEFT CONTROL ON AIR NOZZLE LOOMS

[75] Inventor: Adnan Wahhoud, Lindau/B., Fed. Rep. of Germany

[73] Assignee: Lindauer Dornier GmbH, Lindau, Fed. Rep. of Germany

[21] Appl. No.: 36,465

[22] Filed: Mar. 24, 1993

[30] Foreign Application Priority Data

Mar. 25, 1992 [DE] Fed. Rep. of Germany ..... 4209686

[51] Int. Cl.[5] ..... D03D 47/34

[52] U.S. Cl. ..... 139/116.2; 139/370.2; 139/450

[58] Field of Search ..... 139/450, 116.2, 370.2

[56] References Cited

U.S. PATENT DOCUMENTS 4,815,501 3/1989 Takehana ..... 139/450 X
4,838,319 6/1989 Suwa ..... 139/116.2
5,016,676 5/1991 Fourneaux et al. ..... 139/116.2

FOREIGN PATENT DOCUMENTS 0292044 11/1988 European Pat. Off. ..... 139/450
1904584 6/1972 Fed. Rep. of Germany .
3185155 8/1991 Japan ..... 139/450

*Primary Examiner*—Andrew M. Falik
*Attorney, Agent, or Firm*—W. G. Fasse; W. F. Fasse

[57] ABSTRACT

The inclusion of faulty weft threads into a fabric being woven on an air nozzle loom is prevented with a minimal effort and expense for equipment and control components. For this purpose a sensor upstream of the weft thread insertion components provides the signal of a fault and this signal starts a thread removal program under the control of the loom control unit. The program is stored in the memory of the central computer of the control unit. According to the program the beat up motion is stopped and a predetermined length of weft thread is passed entirely through the insertion channel. When a predetermined number of weft shots have been made or a predetermined length of time has passed, the program provides a signal for the cut off of the faulty section of the weft thread and the faulty section is sucked out of the insertion channel and collected in a container. When the end of the cut off faulty section of weft thread passes an exit monitor, a respective signal is provided to terminate the discarding program and resume normal operation.

10 Claims, 1 Drawing Sheet

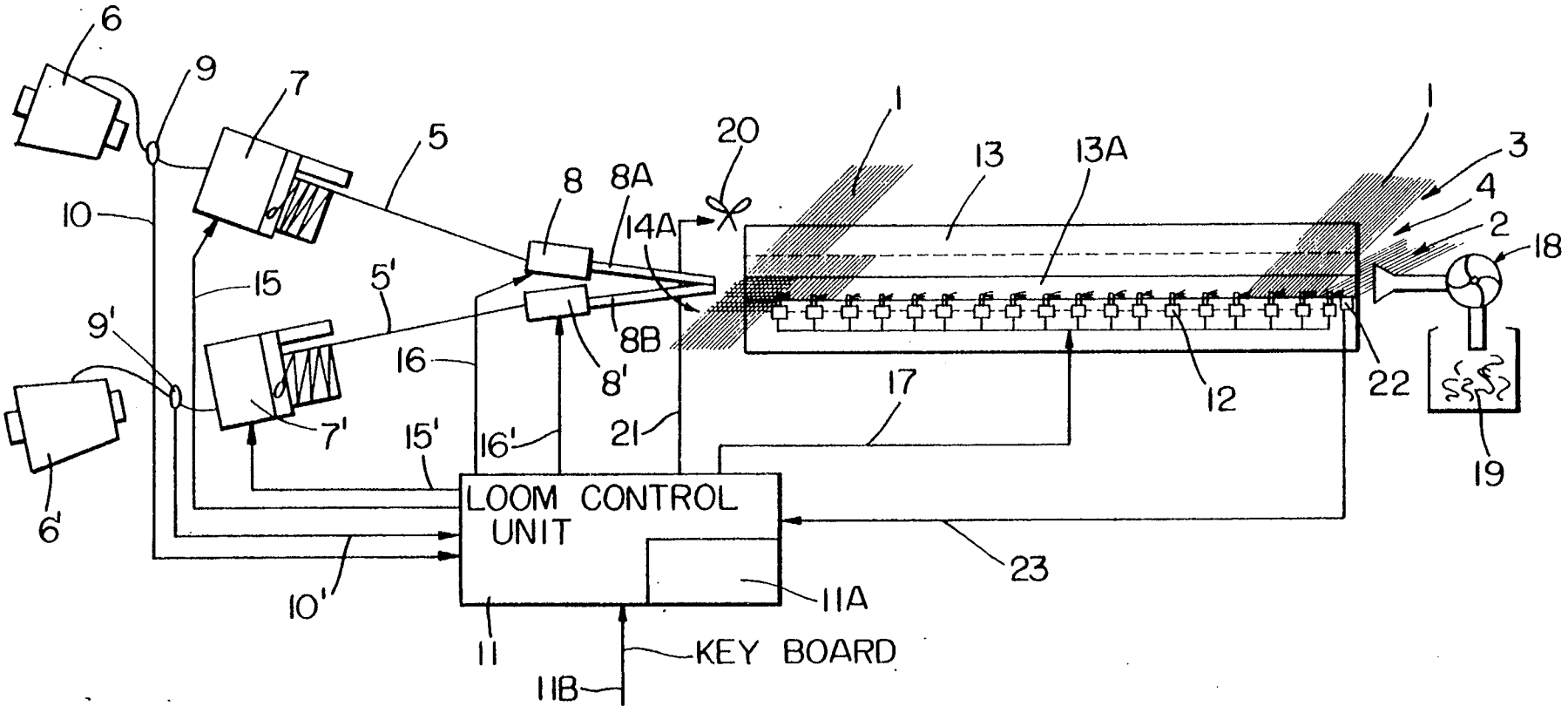
LOOM CONTROL UNIT
KEY BOARD

FAULTY WEFT CONTROL ON AIR NOZZLE LOOMS

FIELD OF THE INVENTION

The invention relates to a method and to an apparatus for producing high quality fabric that is especially free of irregularities such as knots and thick or thin thread portions. Such fabric comprises weft threads and warp threads which are woven on an air nozzle weaving loom. The textile weft threads are pulled off a thread supply and the warp threads form the loom shed.

BACKGROUND INFORMATION

German Patent 1,904,584 (Glass), published on Sep. 18, 1969 relates to a method and apparatus for producing a knot-free fabric. This known method avoids the formation of knots in the fabric in that a motion of the weft thread which contains a knot is initially inserted into the loom shed, but again removed prior to the beat up motion of the reed. The faulty or knotty portion of the weft thread is cut off on the inlet side of the loom shed, whereupon the cut off faulty portion is removed again out of the shed. A knot monitor is arranged along the path of the weft thread from its supply spool to the inlet end of the loom shed. The knot monitor automatically stops the loom in that instance in which the weft thread portion containing the knot has been completely inserted into the shed, but prior to the beat up. Depending on the type of fabric, the loom may be switched on again, either directly after the removal of the faulty thread portion, or after switching the reed back to nullify any part of a beat up motion. A program control is not involved in this type of conventional faulty weft removal.

This known method and apparatus has the disadvantage that additional measures must be taken for removing the faulty weft threat portion of the weft thread that has been completely inserted into the loom shed. These features increase the costs and require a respectively substantial control effort and expense, unless the operator is intended to manually remove the faulty portion of the weft thread, which is also not desirable because it increases dead times.

European Patent Publication EP 0,292,044 (Shaw), published on Nov. 23, 1988, discloses a weaving method and loom which aims at avoiding the weaving of thread irregularities into the fabric. The noncleaned thread is supplied to an air nozzle weaving loom by thread supply coils or so-called yarn packages. These packages contain threads with irregularities, such as thinner sections, thicker sections, knots, entanglements, and wads. These threads are monitored and those thread portions that do not meet a certain requirement are removed by means of devices which involve additional and substantial costs. Thereafter, further weft thread is pulled off the supply packages and if the pulled-off weft thread is recognized to be free faults, it is inserted into the loom shed by means of the weft thread insertion nozzle or nozzles. Where it is necessary to weave a fabric having weft threads of different colors, the effort and expense for the additional structural features for removing undesired weft thread sections becomes prohibitive. For example, if weft threads of eight different colors are to be used, it would be necessary to provide sixteen weft thread storage devices or packages, each requiring the respective additional equipment for the proper removal of faulty sections in each of the differently colored weft threads. Such a solution to the problem of weaving a knot-free fabric is economically not feasible.

OBJECTS OF THE INVENTION

In view of the foregoing it is the aim of the invention to achieve the following objects singly or in combination:

- to provide a method and apparatus for excluding a knotty or otherwise faulty section of a weft thread from its inclusion into a fabric woven on an air nozzle loom, whereby the structural features for such exclusion shall be minimized;
- the required control features shall also be achieved with a minimal effort and expense by a respective control;
- the conventionally available equipment in a loom shall be utilized more efficiently than was possible heretofore; and
- the length of wasted weft thread due to a fault in the weft thread shall be minimized;

SUMMARY OF THE INVENTION

The invention achieves the above objectives in the weaving of a fabric of warp and weft threads in an air nozzle weaving loom by the combination of the following steps. Weft threads are pulled off a weft thread supply. A weft thread quality sensor is located downstream of the weft thread supply, preferably immediately downstream of the supply coil.

The sensor produces a weft thread quality signal that is supplied to a loom control unit for stopping the loom in case a faulty thread representing signal is generated. The weft thread passes immediately downstream of the sensor into a prespooling or prewinding device which in turn leads the weft thread into the main nozzle of the loom. The loom control stops the loom in response to a fault indicating signal. The reed is moved back to open the loom shed. A program for removing the weft thread section with the fault is started. Only now the faulty weft thread section is passed through the open loom shed. Cut off of the weft thread is avoided at the entrance side of the open loom shed until the program is completed. During the program, one or more weft thread lengths may be passed through the loom shed until it is certain that the next weft thread length will be free of faults. The faulty portion of the west thread which may include several sections corresponding to the weaving width, is sucked off at the shed exit, e.g. as waste. The program is stopped and the cut off takes place at the entrance side of the loom shed. When the fault has been removed at the end of the fault removal program, the loom is restarted and normal operation is resumed. A second fault signal restarts the program.

The invention minimizes the waste of weft thread in a fully automatic faulty weft thread removal operation. The removed weft thread portion may be larger than a faulty portion manually removed according to the prior art. However, the rapid resumption of normal weaving operations that is made possible by the invention greatly outweighs any minor economies that may be achieved by a manual faulty weft thread removal. Frequently, the present invention requires the removal of but one weaving width length of faulty weft thread.

In the present apparatus according to the invention the fault sensor is directly positioned between the thread supply spool and the prewinding or spooling device, so that it is assured that only a minimal length of faulty weft thread is placed onto the prewinding device. Conventionally, it was necessary to always keep a full length on the prewinding device, regardless whether there was a fault in that length or not. The present sensor is directly connected to the loom control for initiating a faulty weft thread removal program. When such program is completed normal operation resumes. Preferably, the sensor is so adjusted that when it is most sensitive, no faults at all will be permitted to be entered into the fabric or it may be adjusted to permit weft threads with a permissible fault size to pass.

BRIEF DESCRIPTION OF THE DRAWING

In order that the invention may be clearly understood, it will now be described, by way of example, with reference to the accompanying drawing, wherein the single FIGURE illustrates schematically an air weaving loom equipped according to the invention.

DETAILED DESCRIPTION OF PREFERRED EXAMPLE EMBODIMENTS AND OF THE BEST MODE OF THE INVENTION

The single figure shows an air nozzle weaving loom, whereby only those components that are essential for the disclosure of the invention are shown schematically. The weft thread insertion components are illustrated in duplicate in the left-hand part of the FIGURE for continuing the operation of the loom if one set of insertion components should become empty, the other set can continue the weaving operation. However, the teaching of the invention is equally applicable to both sets of weft thread insertion components.

The warp threads 1 form a lower shed 2 and an upper shed 3 and both sheds 2 and 3 form the loom shed as is conventional. One or the other of the two weft threads 5, 5' is inserted into and through the loom shed by a respective set of weft thread insertion components, including a weft supply spool 6 or 6', a weft quality sensor 9 or 9', a prewinding device 7 or 7', a main nozzle 8 or 8', and main nozzle pipes 8A or 8B. Both sets supply the respective weft thread 5 or 5' into the weft thread insertion channel 13A formed in a reed 13. A series of auxiliary nozzles 12 is arranged along the reed as shown. A suction device 18 is positioned at the exit end of the channel 13A for removing faulty weft threads by suction and depositing such threads in a collection container 19.

According to the invention, a weft thread quality sensor 9 or 9' is preferably arranged immediately downstream of the weft thread supply 6, 6' as viewed in the movement direction of the weft threads from left to right. Thus, these sensors 9, 9' are arranged upstream of the respective prewinding device 7, 7' Each sensor 9, 9' supplies its sensed signal through a respective conductor 10, 10' to the loom control unit 11, which comprises a central processing computer unit including a program memory 11A and a keyboard 11B. A feedback control conductor 15 connects the loom control unit 11 with the prewinding device 7. Similarly, a feedback control conductor 15' connects the control unit 11 with the prewinding device 7'. Control conductors 16 and 16' connect the control unit 11 with the respective main nozzles 8, 8'. A sensor signal conductor 23 supplies a weft arrival signal sensed by a sensor 22, to the control unit 11. The individual or groups of relay nozzles 12 are conventionally controlled through control conductors 17. The produced fabric 14 has a selvage or edge 14A and a weft cutter or scissors 20 is arranged next to the selvage 14A for normally cutting the weft thread in accordance with the weaving loom width in response to an arrival signal from the sensor 22. The cutter 20 is connected to the control unit 11 through a control conductor 21.

The memory 11A of the loom control unit 11 comprises or holds a program for a sequence of control functions in response to signals from the sensors 9, 9' in order to prevent the insertion of faulty weft threads 5, 5' into the loom shed 4 through the main nozzle 8, 8' and the relay nozzles 12. The program also prevents the beat up motion of the reed 13 so that a faulty weft thread is not locked into the fabric 14. The program begins by stopping the loom in response to a fault signal from the sensors 9, 9'.

It is not necessary to eliminate weft threads with minor faults that are permissible without affecting the quality of the fabric. For this purpose the invention provides a keyboard input 11B to allow, for example, an operator to input a threshold value for the signal from the sensors 9, 9'.

Only signals exceeding the threshold are used in the further execution of the program in the memory 11A for the elimination of weft threads with unpermissible faults. The threshold value may be adjusted between a maximum allowable fault value and zero, which causes weft thread lengths having any detected fault to be removed, i.e. no detected fault passes through unremoved.

The present system operates as follows in response to a fault signal from one of the sensors 9, 9'. The fault signal is produced by the sensor 9, 9' when it senses an unacceptably faulty weft thread, e.g. a knot, a thin spot or the like in the weft thread. A fault signal is thus a signal from a sensor 9, 9' which exceeds the selected threshold value. First, the loom is stopped. Then, the main loom shaft is rotated back from its angular position at the time of stopping sufficiently in order to open the loom shed by moving back the reed 13. Next, such a quantity or length of weft thread shots are passed through the shed 4 that the faulty weft thread section has been passed entirely through the weaving width to the right-hand exit of the loom shed. For this purpose, respective signals are provided through the control conductor 15 to the prewinding device 7 and the conductor 16 to the nozzle 8 if the fault was in the weft 5. The same considerations apply regarding conductor 15', device 7', conductor 16' and nozzle 8' if the weft fault was in the weft thread 5'. In both instances proper feed advance signals are also provided through the conductor 17 to the relay nozzles 12 to properly pass the faulty weft thread section through the insertion channel 13A of the reed 13, but without cutting and beat-up.

If, during a program sequence for the removal of a previous fault in the weft, another unacceptable fault is detected by the sensor 9 or 9', the program sequence is stopped and then restarted in response to the signal signifying a new fault.

In any event, the weft thread portion within which a fault has been detected, and which corresponds to at least one full length weft thread shot corresponding to the weaving width, is taken up by the suction device 18 as described above. The number of full length weft shots or a certain time duration corresponding to at least one full length shot duration, are set in the program stored in the memory 11A. These values are normally inserted by the operator through the keyboard.

These values can be ascertained on the basis of conventional loom operation parameters that can be processed by the central processing unit of the control unit. Thus, the number of weft thread lengths to be removed can be determined as a numerical value based on operating experience relating to the type of loom and the type of weft thread. In any event an effort will be made to minimize the waste of weft thread. If possible, based on the machine parameters, only one full length weft will be discarded.

No cutting of the weft thread takes place by the cutter 20 during the discarding of the faulty section. When the preset number of weft thread shots has been passed through the insertion channel 13A, the program in the memory 11A provides a signal to the cutter 20 through the control conductor 21 to cut off the weft thread. The cutter 20 cuts off the weft thread 5 or 5' between the exit of the main nozzle pipes 8A or 8B as the case may be, and the edge 14A of the fabric 14. The cut off portion is fully carried through the channel 13A and collected in the collecting container 19.

The cut off end of the weft thread passes the sensor monitor 22 to provide a respective signal through the conductor 23 to the control unit 11. When the respective thread end signal is received in the unit 11, the discarding program is terminated and the loom restarted. The same operation takes place if a fault is detected in the thread 5'.

Although the invention has been described with referen to specific example embodiments, it will be appreciated that it is intended to cover all modifications and equivalents within the scope of the appended claims.

What I claim is:

1. A method for removing a faulty weft thread length from a weft thread in an air nozzle loom and preventing a beat-up of the faulty weft thread length in a fabric being woven on said air nozzle loom, comprising the following steps:

(a) passing a weft thread through a weft thread quality sensor prior to said weft thread entering into a weft insertion channel, for producing a weft fault signal upon detecting a fault in said weft thread, (b) supplying said weft fault signal to a central loom control having a memory with a weft fault removal program stored in said memory, for starting said fault removal program in response to said weft fault signal, (c) stopping, in response to said weft fault signal, the weaving operation of said loom and causing an opening of a loom shed, (d) causing, in response to said weft fault removal program, the insertion of a number of weft thread lengths through said loom shed while preventing a weft cutting operation and preventing a beat-up motion, said number being at least one, (e) removing said faulty weft thread length at an exit end of said loom shed, (f) providing an end signal signifying that said number of weft thread lengths has been inserted for terminating said fault removal program, (g) cutting said weft thread in response to said program termination, and (h) producing a restart signal and resuming normal weaving in response to said restart signal.

2. The method of claim 1, further comprising determining said number of weft thread lengths as a numerical value based on experience relating to the type of loom and to the type of weft thread, and entering said number into said program.

3. The method of claim 2, wherein said determining and entering said number comprises determining and entering said numerical value as a time duration in seconds.

4. The method of claim 1, further comprising restarting said program sequence upon the occurrence of a second weft fault signal during a preceding program sequence.

5. An air nozzle loom in combination with an apparatus for removing a faulty weft thread length from a weft thread in said air nozzle loom and for preventing a beat-up of the faulty weft thread length in a fabric being woven on said air nozzle loom, said combination comprising a reed (13) with a weft insertion channel (13A) having a weft entrance and a weft exit, a weft thread supply device (6) for supplying weft thread into said loom, a prewinding device (7) positioned downstream of said weft thread supply device (6) as viewed in a direction of weft thread advance, at least one main nozzle (8, 8A) positioned downstream of said prewinding device (7) for inserting said weft thread into said weft insertion channel (13A), a weft cutter (20) between said main nozzle (8, 8A) and said weft entrance, a weft monitor (22) at said weft exit for producing a restart signal, a suction device (18) at said weft exit for collecting said faulty weft thread length, a weft thread quality sensor (9) positioned downstream of said weft thread supply device for producing a weft fault signal, a central control unit including a memory (11A) having a fault removal program stored in said memory, electrical conductors connecting said quality sensor (9) and said weft monitor (22) to said central control unit, and electrical control conductors connecting said central control unit to said prewinding device (7), to said main nozzle (8), and to said weft cutter (20) for operating said loom and for performing said fault removal program for removing said faulty weft thread length without beat-up and without cutting until a predetermined weft length has been removed by said suction device.

6. The apparatus of claim 5, wherein said weft thread quality sensor is positioned between said weft thread supply device and said prewinding device (7).

7. The apparatus of claim 5, wherein said central control unit comprises means for determining said predetermined weft lengths as a whole number of weft sections each having a length corresponding to a weaving width.

8. The apparatus of claim 5, wherein said central control unit comprises means for determining said predetermined weft length as a length of time during which said fault removal program is performed.

9. The apparatus of claim 5, wherein said central control unit contains a programmed threshold value for a weft fault, so that minor acceptable faults do not trigger said fault removal program.

10. The apparatus of claim 9, further comprising means for adjusting said threshold value between zero and a maximum acceptable fault.

* * * * *